United States Patent [19]

Wood, Jr.

[11] Patent Number: 4,601,666

[45] Date of Patent: Jul. 22, 1986

[54] AIR EXHAUST BY-PASS FOR UNDERWATER EXHAUST SYSTEMS

[76] Inventor: Garfield A. Wood, Jr., 400 Teakwood Dr., Monroe, La. 71203

[21] Appl. No.: 700,337

[22] Filed: Feb. 12, 1985

Related U.S. Application Data

[63] Continuation of Ser. No. 497,651, May 24, 1983, abandoned.

[51] Int. Cl.[4] ..... B63H 21/32

[52] U.S. Cl. ..... 440/89

[58] Field of Search ..... 440/89; 123/188 R, 190 R, 123/84, 445, 568; 60/288, 602, 600, 279; 181/236, 277; 261/DIG. 74

[56] References Cited

U.S. PATENT DOCUMENTS

| | | | |
|---|---|---|---|
| 871,459 | 11/1907 | Thorsen | 440/89 |
| 929,057 | 7/1909 | Walters | 440/89 |
| 3,045,423 | 7/1962 | Hulsebus | 440/89 |
| 3,174,275 | 3/1965 | Collin | 60/600 |
| 3,282,046 | 11/1966 | Walker | 60/288 |
| 3,282,373 | 11/1966 | Gazzaka | 181/236 |
| 3,371,645 | 3/1968 | Ward | 440/89 |
| 3,552,121 | 1/1971 | Kitagawa | 440/89 |
| 3,576,172 | 4/1971 | Ward | 440/89 |
| 3,646,764 | 3/1972 | Nakajima | 60/279 |
| 4,151,499 | 4/1979 | Ganowsky | 261/DIG. 74 |

FOREIGN PATENT DOCUMENTS

| | | | |
|---|---|---|---|
| 446915 | 5/1936 | United Kingdom | 181/236 |

*Primary Examiner*—Trygve M. Blix
*Assistant Examiner*—Stephen P. Avila
*Attorney, Agent, or Firm*—Woodcock Washburn Kurtz Mackiewicz & Norris

[57] ABSTRACT

This invention relates to outboard motors and inboard-outboard motors and more specifically to the underwater exhaust systems built into both of these types of marine propulsion. The object of this invention is to provide a method of and apparatus for selective rerouting the underwater exhaust through a muffled above water outlet while effectively blocking the underwater exhaust emanations.

12 Claims, 9 Drawing Figures

AIR EXHAUST BY-PASS FOR UNDERWATER EXHAUST SYSTEMS

This is a continuation of application Ser. No. 497,651 filed May 24, 1983, now abandoned.

BACKGROUND OF THE INVENTION

This invention relates to outboard motors and inboard-outboard motors and more specifically to the underwater exhaust systems built into both of these types of marine propulsion particularly as used for fishing. It is well known that low frequency underwater sounds can be detected for great distances through water while sounds of higher frequencies attenuate rapidly and can be detected for only relatively short distances. Marine biologists have established that all fish are capable of hearing and that there is high sensitivity in regard to extremely low frequency sounds which make up the predominant portion of all underwater noises. The fish utilizes this acute hearing to carry on its normal living functions including protection of prey and awareness of potential enemies. All running powerboats radiate underwater noise similar in frequency to natural underwater noise and, in most cases, of considerably greater magnitude. This noise comes from three main sources. One is machinery noise—that generated by the motors. Another is cavitation noise produced by the propellers. The third is exhaust noise which becomes evident only when the exhaust is discharged below the water surface and, in this case of considerably greater magnitude than the machinery noise. During low speed operation, cavitation noise is not generated. Machinery noise can be reduced to acceptable intensity levels by sound insulating materials. Underwater exhaust noise, which is the predominant irritant to fish during low power operation, cannot be directly reduced in intensity but can be eliminated by means of an air exhaust by-pass as hereinafter described in accordance with the present invention.

The early outboard motors were low powered and designed to clamp to the stern of rowboats. They were a very acceptable substitute for rowing and enhanced the most effective method of fishing, which is trolling, by extending the territory which could be covered by several times. These early outboards had air exhausts and were noisy for passengers when run at even intermediate speeds. At trolling speeds the passenger noise level was not high and the number of fish striking was nearly the same as when rowing. Daily catches were higher because the fishing time was longer. Previously, the rower's back or arms would give out after a short time. As outboards grew in size, the high speed motor noise increased to a point where passengers were made uncomfortable and persons on shore became annoyed. It was found that, by routing the motor exhaust through a tube below the water level and releasing it there, the motor noise was considerably lessened for both passengers and bystanders. Thus, the universally used underwater exhaust was developed. At the time, no studies of the effect that underwater noise had on marine ecology were made. When trolling produced far fewer fish, it was thought that the area had been "fished out" although adequate catches were still being made by casting or still fishing. Today, scuba divers and snorklers realize that outboards and inboard-outboards generate excessive underwater noise. It is, however, looked upon as a necessary evil inherent to an economical means of pursuing their sport.

Summary of the Invention

In accordance with the present invenion in a marine propulsion system having an integral underwater exhaust system, there is provided a method of and apparatus for selectively rerouting the underwater exhaust through a muffled above water outlet while effectively blocking underwater exhaust emanations. The present invention is adapted to be used primarily during periods of low power applications, since high power operation will result in excessive above water noise. The air exhaust mode may be actuated either manually or by automatic coordination with the throttle. The main purpose is to reduce the underwater noise which has a highly irritating effect on marine denizens as well as somewhat annoying to participants in underwater sports. A secondary object of this invention is to provide improved low speed and idling operation of the basic motors. All present underwater exhaust systems have been designed to reduce back pressure while the boat is moving forward rapidly. However, at low speeds, when idling or when reversing, the back pressure build-up, due to the water head, causes incomplete exhaust scavaging, which, in return, results in poor combustion and subsequent rough, smokey performance. The present invention, when adjusted to the air exhaust mode, will reduce back pressure to a minimum so that low power motor operation will be smoother, more economical and much cleaner from a material pollution standpoint.

Other features and advantages of the invention and a more complete understanding of the invention will become apparent from the following detailed description, taken in conjunction with the accompanying drawings which form a part of this specification.

DETAILED DESCRIPTION OF THE PREFERRED EMBODIMENTS

Figure 1:
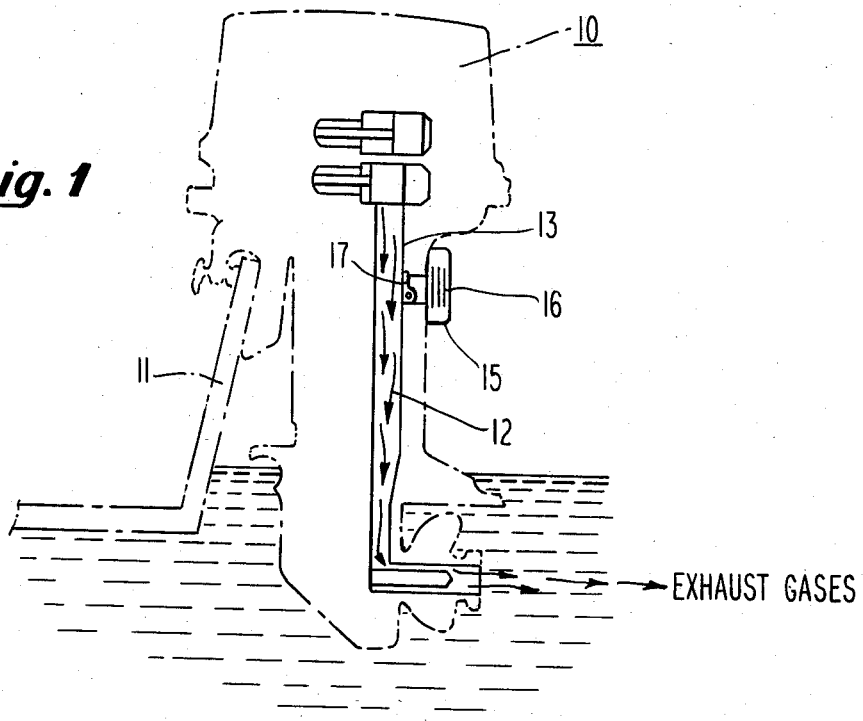
FIG. 1 is a diagramatic view showing an outboard motor embodying the new underwater exhaust system with a selectively operated air exhaust by-pass valve of the present invention.

Referring now to the drawings, wherein like reference characters refer to like parts throughout the several views, there is shown in FIG. 1 an embodiment of a by-pass underwater exhaust system of the invention. By way of example, there is illustrated in FIG. 1 a typical outboard motor 10, illustrated in phantom lines, attached to the stern of a boat 11, also shown in phantom lines. The exhaust gases illustrated by the solid line 12 arrows in FIG. 1 are passing downwardly through the exhaust passage 13 where they are discharged through the propeller and beneath the surface of the water. In another typical underwater exhaust system, not shown, the exhaust gases are discharged adjacent the propeller but beneath the water level. Either of these conventional exhaust systems are adapted for use with the present invention which will now be described.

Figure 2:
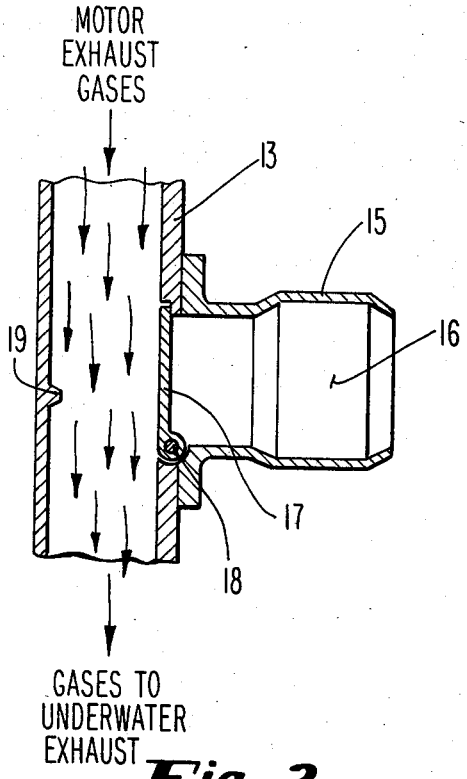
FIG. 2 is a fractional view on enlarged scale of FIG. 1 showing the exhaust by-pass valve in closed position with the motor exhaust gases being discharged under water.
Figure 3:
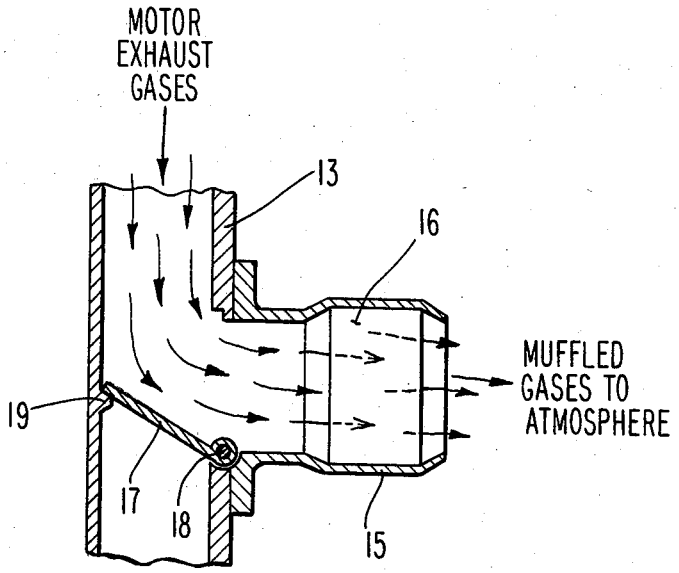
FIG. 3 shows a fractional view of FIG. 1 on enlarged scale with the exhaust valve in open position where the exhaust gases are discharged through a muffler to atmosphere.

As shown in FIGS. 1–3 there is attached to the vertical exhaust passage 13 a housing 15 having a muffler 16 disposed therein and a flapper type valve 17. The flapper type valve 17 as shown in FIGS. 1–3 is pivotally mounted at 18 for movement between the closed position as shown in FIGS. 1 and 2 and the open position as shown in FIG. 3. With the flapper valve 17 in closed position as shown in FIG. 2, the motor exhaust gases pass downwardly through the vertical exhaust passage 13 and out through the lower end thereof at a position beneath the water level as shown in FIG. 1. When the valve 17 is moved to open position as shown in FIG. 3, the motor exhaust gases are diverted out through the muffler 16 to atmosphere. The exhaust passage 13 preferably is provided with a stop member 19 against which the valve 17 rests when it is in open position, as illustrated in FIG. 3.

Figure 4:
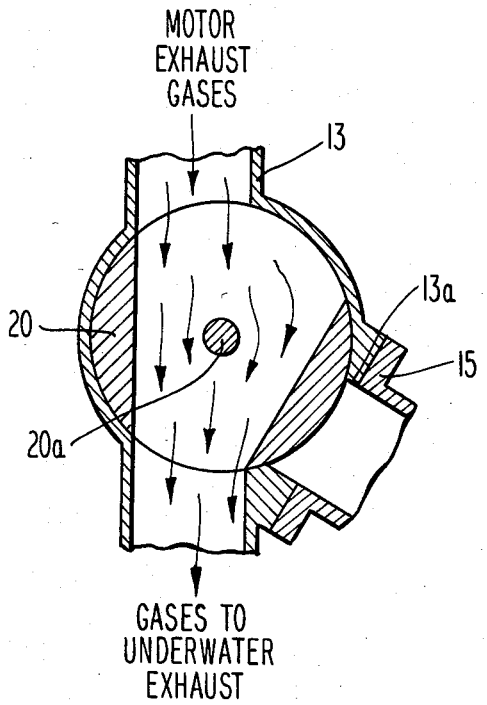
FIGS. 4 and 5 illustrate a modification of the invention utilizing a rotary valve for selectively discharging the motor exhaust gases underwater in FIG. 4 or through a muffler to atmosphere in FIG. 5.
Figure 5:
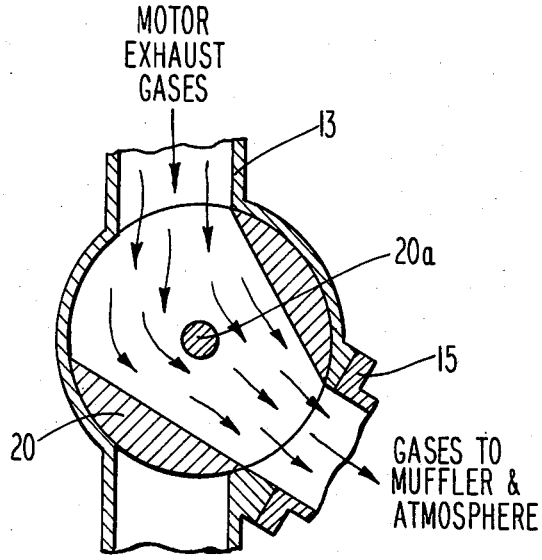

Referring to FIGS. 4 and 5 the present invention has been illustrated in connection with a rotary valve 20 ported to allow positioning in either the underwater or air exhaust modes. In FIG. 4, the rotary valve 20 is positioned in the vertical exhaust passage 13 with the ports of the valve 20 arranged to permit the motor exhaust gases to pass downwardly thereto to a position for exhaust beneath the surface of the water. The valve 20 seals off the side opening 13*a* through the exhaust passsage 13 that communicates with the housing 15 for the muffler, not shown. In FIG. 5 the valve 20 has been rotated about its central pivot 20*a* so that the ports now communicate with the motor exhaust gas passage 13 and with the opening into the housing 15 for the muffler. In this position of the rotary valve 20 the exhaust gases are directed through to the muffler and discharged to atmosphere about the water level.

Figure 6:
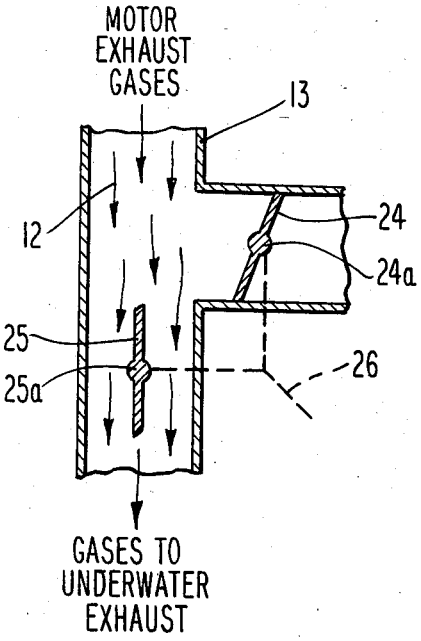
FIGS. 6 and 7 illustrate another modification of the invention utilizing a dual butterfly system where the motor exhaust gases are selectively discharged to underwater in FIG. 6 or through a muffler to atmosphere in FIG. 7.
Figure 7:
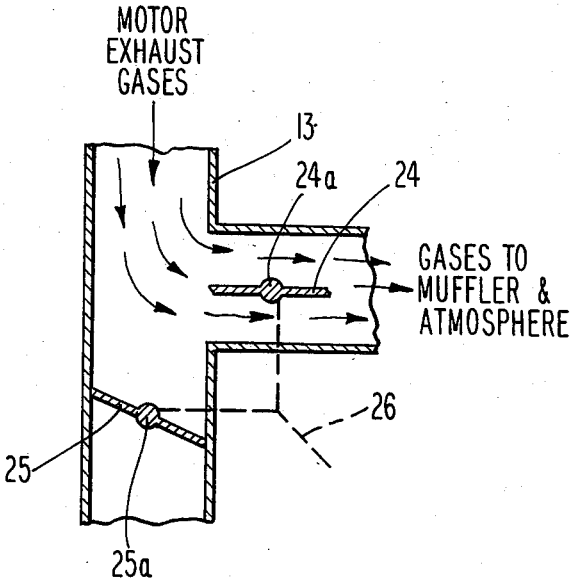

In FIGS. 6 and 7 there is illustrated another embodiment of the present invention utilizing a dual butterfly valve system which can be coordinated to perform the same funtions as the single valves shown in FIGS. 1–5. In FIGS. 6 and 7 there is illustrated a pair of butterfly valves 24 and 25 which are pivotally mounted at 24*a* and 25*a* respectively in the motor exhaust passage 13. With the dual valves 24 and 25 positioned as shown in FIG. 6, the motor exhaust gases pass downwardly through the motor exhaust passage 13 and are discharged at a location beneath the surface of the water. The valve 24 and the valve 25 are mechanically connected as indicated by the broken lines in FIGS. 6 and 7 for operation by a common lever 26. As shown in FIG. 6 the valve 24 is in closed position while the valve 25 is in open position. The closed valve 24 prevents the flow of motor exhaust gases to the muffler and atmosphere not shown in FIG. 6. When the dual valves 24 and 25 are moved to the position shown in FIG. 7, the exhaust gases are directed through the now opened valve 24 to the muffler, not shown, and discharged to atmosphere above the water level. The valve 25 is now in closed position thus preventing the discharge of exhaust gases beneath the surface of the water.

Figure 8:
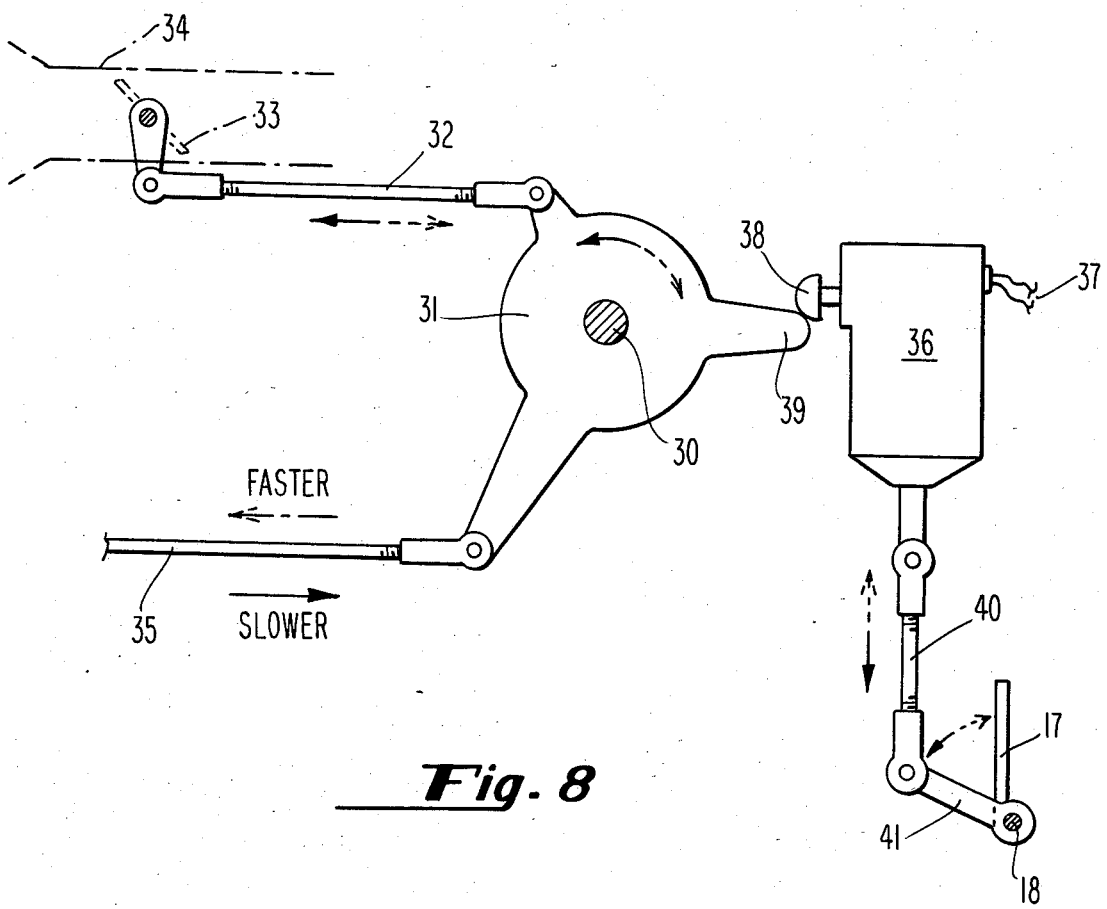
FIG. 8 illustrates the present invention in connection with a solenoid actuated air exhaust by-pass valve.

While all of the above described embodiments of air by-pass mechanisms lend themselves to manual operation, the embodiments illustrated in FIGS. 2–5 particularly lend themselves to solenoid operation and mechanical operation as now to be described in connection with FIGS. 8 and 9. In FIG. 8 there is illustrated a control cam journal 30 which is common to all outboards and inboard-outboard motors. Mounted on the control cam journal 30 is a control cam 31 to which is attached an adjustable control linkage 32 for operating the carburetor butterfly valve 33 in the carburetor 34. The butterfly valve 33 and the carburetor 34 are shown in phantom lines as they are conventional parts of an outboard motor. Also attached to the control cam 31 is throttle cable 35 which when moved in the direction of the broken line arrow causes the motor to go faster and when moved in the direction of the solid line error causes the motor to go slower. Mounted adjacent the control cam 31 is a D.C. solenoid 36 which is adapted to be energized from a D.C. current supply 37. The solenoid 36 is provided with a solenoid operating switch button 38 which is adapted for engagement by a by-pass valve cam lobe 39 on the control cam 31. The solenoid 36 has attached thereto a control linkage 40 which is adjustable as to length and is in turn connected to a by-pass valve control lever 41. The lever 41 is also attached to the pivot 18 for the flapper valve 17 also shown in FIGS. 2 and 3. When the motor throttle 35 is in advanced (faster) position the cam lobe 39 is rotated away from the solenoid switch button 38 and the solenoid shaft extension is in retracted position as shown in FIG. 8. With the parts in this position, the control valve 17 is in the underwater exhaust mode as illustrated in FIG. 2. As the motor is slowed, the control cam 31 is moved in counter clockwise direction which causes the cam lobe 39 to make contact with the switch button 38 thereby actuating the solenoid 36 which in turn extends the solenoid shaft and linkage 40. This causes the linkage 40 to move downardly in the direction of the solid line arrow in FIG. 8 which in turn causes the by-pass valve control lever 41 to move in counter clockwise direction of the solid line arrow and rotates the by-pass control valve 17 to the position shown in FIG. 3. Thus it will be seen that the by-pass valve 17 has been switched from the underwater exhaust mode to FIG. 2 to the air exhaust mode of FIG. 3. Speeding up the motor by increasing the throttle reverses this procedure. The cam lobe 39 and switch button 38 are shaped so that contact continues through the slowest throttle position. The solenoid 36 is deactivated when the ignition is turned off. The solenoid actuated valve arrangement has the advantage that the valve 17 snaps fully open to the air exhaust mode when the switch is activated and fully open to the underwater mode. when the switch is turned off. This arrangement also provides a somewhat lower throttle resistance when in the air exhaust mode.

Figure 9:
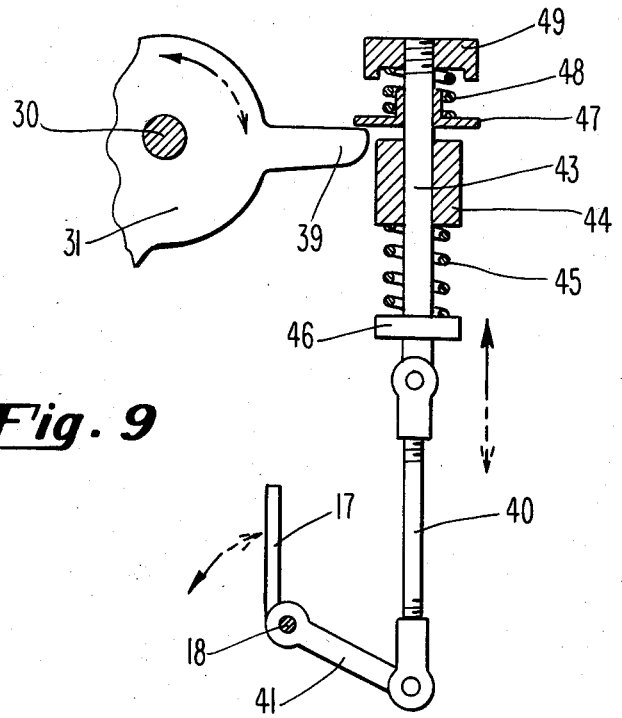
FIG. 9 illustrates the present invention in connection with a mechanically actuated air exhaust by-pass valve.

Referring to FIG. 9 the control cam 31 has been illustrated in connection with a mechanically actuated valve system. A shaft 43 is mounted in a shaft journal 44. A return compression spring 45 is mounted on the shaft 43 between a collar 46 and the shaft journal 44. A compression spring retainer 47 and a compression 48 are mounted on the upper end of the shaft 43 adjacent the lock nut/spring retainer 49 which is threadedly secured to the upper end of the shaft 43. The cam lobe 39 in FIG. 9, is adapted to be positioned adjacent the slideable spring retainer 47 for movement into and out of engagement therewith as now to be described. When the motor throttle is in advanced (faster) position, the cam lobe 39 is rotated away from the slidable spring retainer 47 and the return spring 45 holds the by-pass control lever 41 and valve 17 in the position shown in FIG. 9. In this position, the valve 17 is in the underwater exhaust mode shown in FIG. 2. As the motor is slowed, the cam lobe 39 moves against the spring retainer 47 and moves the shaft 43 upward first compressing the return spring 45 and, as the throttle is retarded, continues to compress compression spring 48 after the return spring 45 is fully compressed. In this position, the valve 17 is in the air exhaust mode shown in FIG. 3. Thus the control cam 31, the control linkage 40 and the valve 17 have all moved in the direction of their respective solid line arrows in FIG. 9. Increasing the throttle reverses this procedure for return of the valve 17 to the underwater exhaust mode shown in FIG. 2. The compression spring 48 preferably is slightly heavier than the return spring 45 so that it does not compress until the return spring 45 is at its shortest length. The advantages of the mechanically actuated valve system in FIG. 9 are that it is fully reliable as long as lubrication is present and slightly lower in cost than the solenoid system shown in FIG. 8.

While the operation of FIGS. 8 and 9 have been described in connection with the flapper valve 17 of FIGS. 2 and 3 it is to be understood that the rotary valve of FIGS. 4 and 5 may be substituted therefor with no change in operation or function. For convenience in the claims, the term outboard motor is used genericly to include inboard/outboard motors. It is to be understoood that the selective valving mechanism illustrated in the drawings are illustrative and that other valving mechanisms may be utilized in practicing the invention including slidable gate valves.

What is claimed:

1. In a marine propulsion system for a fishing boat having a motor with an integral underwater exhaust system, the improvement of reducing the fish sensitive low frequency underwater noise generated by the exhaust during low speed operation of the motor comprising a muffled above water outlet to the air for the exhaust, and selectively operated means comprising a manually controlled selective valving mechanism for rerouting the exhaust through said muffled above water outlet to the air while preventing exhaust emanations from either impinging directly upon the water surface or passing to any underwater level by blocking movement of the exhaust to the water level at a point above the water surface for discharge through the muffled outlet to the air at low speed operation and for allowing the exhaust system to return to normal underwater exhaust conditions at faster speed operation where the overall sound frequencies become higher.

2. In a marine propulsion system for a fishing boat having a motor with an integral underwater exhaust system, the improvement of reducing the fish sensitive low frequency underwater noise generated by the exhaust during low speed operation of the motor comprising a muffled above water outlet to the air for the exhaust, and selectively operated means comprising a throttle controlled selective valving mechanism for rerouting the exhaust through said muffled above water outlet to the air while preventing exhaust emanations from either impinging directly upon the water surface or passing to any underwater level by blocking movement of the exhaust to the water level at a point above the water surface for discharge through the muffled outlet to the air at low speed operation and for allowing the exhaust system to return to normal underwater exhaust conditions at faster speed operation where the overall sound frequencies become higher.

3. In a marine propulsion system for a fishing boat having a motor with an integral underwater exhaust system, the improvement of reducing the fish sensitive low frequency underwater noise generated by the exhaust during low speed operation of the motor comprising a muffled above water outlet to the air for the exhaust, and selectively operated means comprising a selective flapper valve for rerouting the exhaust through said muffled above water outlet to the air while preventing exhaust emanations from either impinging directly upon the water surface or passing to any underwater level by blocking movement of the exhaust to the water level at a point above the water surface for discharge through the muffled outlet to the air at low speed operation and for allowing the exhaust system to return to normal underwater exhaust conditions at faster speed operation where the overall sound frequencies become higher.

4. In a marine propulsion system for a fishing boat having a motor with an integral underwater exhaust system, the improvement of reducing the fish sensitive low frequency underwater noise generated by the exhaust during low speed operation of the motor comprising a muffled above water outlet to the air for the exhaust, and selectively operated means comprising a selective rotary valve for rerouting the exhaust through said muffled above water outlet to the air while preventing exhaust emanations from either impinging directly upon the water surface or passing to any underwater level by blocking movement of the exhaust to the water level at a point above the water surface for discharge through the muffled outlet to the air at low speed operation and for allowing the exhaust system to return to normal underwater exhaust conditions at faster speed operation where the overall sound frequencies become higher.

5. In a marine propulsion system for a fishing boat having a motor with an integral underwater exhaust system, the improvement of reducing the fish sensitive low frequency underwater noise generated by the exhaust during low speed operation of the motor comprising a muffled above water outlet to the air for the exhaust, and selectively operated means comprising dual operating valves for rerouting the exhaust through said muffled above water outlet to the air while preventing exhaust emanations from either impinging directly upon the water surface or passing to any underwater level by blocking movement of the exhaust to the water level at a point above the water surface for discharge through the muffled outlet to the air at low speed operation and or allowing the exhaust system to return to normal underwater exhaust conditions at faster speed operation where the overall sound frequencies become higher.

6. The improvement for an outboard motor having an integral passage for an underwater exhaust system wherein the fish sensitive low frequency underwater noise of the exhaust system during low speed operation of the motor is reduced, said improvement comprising muffler housing means connected to the motor at a location normally above the water level and communicating with the exhaust passage intermediate the ends thereof at a location normally above the water outlet, a muffler disposed within said housing to provide a muffled above water outlet to the air for the exhaust emanations from the motor, and selectively operated means comprising manually controlled selective valving mechanism for rerouting the exhaust through said muffled above water outlet while effectively preventing exhaust emanations from either impinging directly upon the water surface or from passing to any underwater level at low speed operations by blocking movement of exhaust to the water level at a point above the water surface for discharge through the muffled outlet to the air at low speed operations and for allowing the motor to return to normal underwater exhaust conditions at faster speed operation where the overall sound frequencies become higher.

7. The improvement for an outboard motor having an integral passage for an underwater exhaust system wherein the fish sensitive low frequency underwater noise of the exhaust system during low speed operation of the motor is reduced, said improvement comprising muffler housing means connected to the motor at a location normally above the water level and communicating with the exhaust passage intermediate the ends thereof at a location normally above the water outlet, a muffler disposed within said housing to provide a muffled above water outlet to the air for the exhaust emanations from the motor, and selectively operated means comprising a solenoid actuated air exhaust by-pass valve for rerouting the exhaust through said muffled above water outlet while effectively preventing exhaust emanations from either impinging directly upon the water surface or from passing to any underwater level at low speed operations by blocking movement of exhaust to the water level at a point above the water surface for discharge through the muffled outlet to the air at low speed operations and for allowing the motor to return to normal underwater exhaust conditions at faster speed operation where the overall sound frequencies become higher.

8. The improvement for an outboard motor having an integral passage for an underwater exhaust system wherein the fish sensitive low frequency underwater noise of the exhaust system during low speed operation of the motor is reduced, said improvement comprising muffler housing means connected to the motor at a location normally above the water level and communicating with the exhaust passage intermediate the ends thereof at a location normally above the water outlet, a muffler disposed within said housing to provide a muffled above water outlet to the air for the exhaust emanations from the motor, and selectively operated means comprising a mechanically actuated air exhaust by-pass valve for rerouting the exhaust through said muffled above water outlet while effectively preventing exhaust emanations from either impinging directly upon the water surface or from passing to any underwater level at low speed operations by blocking movement of exhaust to the water level at a point above the water surface for discharge through the muffled outlet to the air at low speed operations and for allowing the motor to return to normal underwater exhaust conditions at faster speed operation where the overall sound frequencies become higher.

9. The improvement for an outboard motor having an integral passage for an underwater exhaust system wherein the fish sensitive low frequency underwater noise of the exhaust system during low speed operation of the motor is reduced, said improvement comprising muffler housing means connected to the motor at a location normally above the water level and communicating with the exhaust passage intermediate the ends thereof at a location normally above the water outlet, a muffler disposed within said housing to provide a muffled above water outlet to the air for the exhaust emanations from the motor, and selectively operated means comprising a throttle controlled selective valving mechanism for rerouting the exhaust through said muffled above water outlet while effectively preventing exhaust emanations from either impinging directly upon the water surface or from passing to any underwater level at low speed operations by blocking movement of exhaust to the water level at a point above the water surface for discharge through the muffled outlet to the air at low speed operations and for allowing the motor to return to normal underwater exhaust conditions at faster speed operation where the overall sound frequencies become higher.

10. The improvement for an outboard motor having an integral passage for an underwater exhaust system wherein the fish sensitive low frequency underwater noise of the exhaust system during low speed operation of the motor is reduced, said improvement comprising muffler housing means connected to the motor at a location normally above the water level and communicating with the exhaust passage intermediate the ends thereof at a location normally above the water outlet, a muffler disposed within said housing to provide a muffled above water outlet to the air for the exhaust emanations from the motor, and selectively operated means comprising a selective flapper valve for rerouting the exhaust through said muffled above water outlet while effectively preventing exhaust emanations from either impinging directly upon the water surface or from passing to any underwater level at low speed operations by blocking movement of exhaust to the water level at a point above the water surface for discharge through the muffled outlet to the air at low speed operations and for allowing the motor to retun to normal underwater exhaust conditions at faster speed operation where the overall sound frequencies become higher.

11. The improvement for an outboard motor having an integral passage for an underwater exhaust system wherein the fish sensitive low frequency underwater noise of the exhaust system during low speed operation of the motor is reduced, said improvement comprising muffler housing means connected to the motor at a location normally above the water level and communicating with the exhaust passage intermediate the ends thereof at a location normally above the water outlet, a muffler disposed within said housing to provide a muffled above water outlet to the air for the exhaust emanations from the motor, and selectively operated means comprising a selective rotary valve for rerouting the exhaust through said muffled above water outlet while effectively preventing exhaust emanations from either impinging directly upon the water surface or from passing to any underwater level at low speed operations by blocking movement of exhaust to the water level at a point above the water surface for discharge through the muffled outlet to the air at low speed operations and for allowing the motor to return to normal underwater exhaust conditions at faster speed operation where the overall sound frequencies become higher.

12. The improvement for an outboard motor having an integral passage for an underwater exhaust system wherein the fish sensitive low frequency underwater noise of the exhaust system during low speed operation of the motor is reduced, said improvement comprising muffler housing means connected to the motor at a location normally above the water level and communicating with the exhaust passage intermediate the ends thereof at a location normally above the water outlet, a muffler disposed within said housing to provide a muffled above water outlet to the air for the exhaust emanations from the motor, and selectively operated means comprising dual operating butterfly valves for rerouting the exhaust through said muffled above water outlet while effectively preventing exhaust emanations from either impinging directly upon the water surface or from passing to any underwater level at low speed operations by blocking movement of exhaust to the water level at a point above the water surface for discharge through the muffled outlet to the air at low speed operations and for allowing the motor to retun to normal underwater exhaust conditions at faster speed operation where the overall sound frequencies become higher.

* * * * *